US010235941B2

(12) United States Patent
Zhou

(10) Patent No.: US 10,235,941 B2
(45) Date of Patent: Mar. 19, 2019

(54) PIXEL CIRCUIT

(71) Applicant: EverDisplay Optronics (Shanghai) Limited, Shanghai (CN)

(72) Inventor: Sisi Zhou, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 90 days.

(21) Appl. No.: 15/356,319

(22) Filed: Nov. 18, 2016

(65) Prior Publication Data

US 2017/0148389 A1 May 25, 2017

(30) Foreign Application Priority Data

Nov. 20, 2015 (CN) ..... 2015 1 0811733

(51) Int. Cl.
*G09G 3/3258* (2016.01)

(52) U.S. Cl.
CPC ... *G09G 3/3258* (2013.01); *G09G 2300/0842* (2013.01); *G09G 2310/0251* (2013.01)

(58) Field of Classification Search
CPC .. G09G 3/3233; G09G 3/3208; G09G 3/3225; G09G 3/3258
USPC ..... 345/76, 82; 315/169.3
See application file for complete search history.

(56) References Cited

U.S. PATENT DOCUMENTS

| | | | | |
|---|---|---|---|---|
| 7,542,019 | B2 * | 6/2009 | Park | G09G 3/3233 345/205 |
| 8,188,947 | B2 * | 5/2012 | Chung | G09G 3/3233 345/76 |
| 2005/0285827 | A1 * | 12/2005 | Eom | G09G 3/3233 345/76 |
| 2006/0022909 | A1 * | 2/2006 | Kwak | G09G 3/3233 345/76 |
| 2006/0113551 | A1 * | 6/2006 | Kwak | G09G 3/3233 257/85 |
| 2006/0114193 | A1 * | 6/2006 | Kwak | G09G 3/3233 345/76 |
| 2007/0229411 | A1 * | 10/2007 | Choi | G09G 3/3233 345/76 |
| 2008/0036704 | A1 * | 2/2008 | Kim | G09G 3/3233 345/76 |
| 2009/0096721 | A1 | 4/2009 | Chou et al. | |
| 2014/0176402 | A1 * | 6/2014 | Lee | G09G 3/32 345/77 |
| 2017/0076646 | A1 * | 3/2017 | Gu | G09G 3/003 |

FOREIGN PATENT DOCUMENTS

| | | |
|---|---|---|
| CN | 101903936 A | 12/2010 |
| CN | 104391409 A | 3/2015 |

* cited by examiner

*Primary Examiner* — Koosha Sharifi-Tafreshi
(74) *Attorney, Agent, or Firm* — Andrew F. Young, Esq.; Lackenbach Siegel, LLP

(57) ABSTRACT

The present invention relates to a pixel circuit comprising a first sub-pixel circuit and a second sub-pixel circuit, and the first sub-pixel circuit comprises a first light-emitting element which emits light in the first half of a frame period, and the second sub-pixel circuit comprises a second light-emitting element which emits light in the second half of the frame period.

13 Claims, 9 Drawing Sheets

PIXEL CIRCUIT

The present application claims priority to and the benefit of Chinese Patent Application No. CN 201510811733.8, filed on Nov. 20, 2015, the entire content of which is incorporated herein by reference.

BACKGROUND OF THE INVENTION

Field of the Invention

The invention relates to the field of display, more specifically, to the design of the AMOLED pixel circuit area.

Description of the Related Art

In the pixel circuit design of the prior art, in order to compensate for the threshold voltage that drives the thin film transistor (TFT), a compensating circuit is typically adopted, e.g., in a conventional 6T1C pixel circuit, a single pixel circuit with a compensation effect is mainly composed of six PMOS (P-channel Metal Oxide Semiconductor) thin film transistors and a storage capacitor Cs. In general in the pixel circuit, the drive transistor driving the light-emitting diode corresponds to the source-follow device, and the size thereof is generally large, so that the overall size of the pixel circuit is inevitably increased. The principal contradiction of the prior art is that, the drive transistor and the storage capacitor occupy a large area in the pixel circuit, which greatly limits the resolution of the display panel, so that when the size of the display panel almost does not increase, it is necessary to provide a new pixel circuit to improve the resolution of the panel.

SUMMARY OF THE INVENTION

In an alternative embodiment, the present application provides a pixel circuit comprising a first sub-pixel circuit and a second sub-pixel circuit; the first sub-pixel circuit comprises a first light-emitting element, and the second sub-pixel circuit comprises a second light-emitting element, wherein the first light-emitting element emits light in the first half of a frame period, and the second light-emitting element emits light in the second half of the frame period.

In the above-mentioned pixel circuit, the first sub-pixel circuit comprises: a storage, capacitor connected between a first node and a first voltage input end; a first transistor, connected between the first node and a second voltage input end; a third transistor connected between a second node and a data line input end; a fourth transistor and a sixth transistor connected in series between an anode of the first light-emitting element and the second node; wherein a control terminal of the sixth transistor is connected to the first node; a second transistor connected between the first node and a third node positioned at the interconnection point of the fourth transistor and the sixth transistor; and a fifth transistor connected between the second node and the first voltage input end.

In the above-mentioned pixel circuit, the second sub-pixel circuit comprises: a seventh transistor, connected between the third node and an anode of the second light-emitting element; and an eighth transistor, connected in parallel with the fifth transistor.

In the above-mentioned pixel circuit, a first supply voltage is input to the first voltage input end, and a second supply voltage is input to the cathodes of the first light-emitting element and the second light-emitting element; a first scanning signal is coupled to the control terminal of the first transistor, a second scanning signal is coupled to both the control terminals of the second transistor and the third transistor; a first enable signal is coupled to both the control terminals of the fourth transistor and the fifth transistor, and a second enable signal is coupled to both the control terminals of the seventh transistor and the eighth transistor; and a data voltage signal is input to a first end of the third transistor, a second end of the third transistor is connected to the second node, and a reference voltage is input to a first end of the first transistor, a second end of the first transistor is connected to the first node.

In the above-mentioned pixel circuit, during the first half of the frame period, the second enable signal having a first logic state keeps the seventh transistor and the eight transistor being switched off, so as to switch off the second light-emitting element; during the second half of the frame period, the first enable signal having the first logic state keeps the fourth transistor and the fifth transistor being switched off, so as to switch off the first light-emitting element.

In the above-mentioned pixel circuit, during the first half of the frame period, in an initialization phase of the storage capacitor, the first scanning signal has a second logic state to switch on the first transistor, and initialize the electric potential of the first node into the reference voltage level; and then, in a writing phase of the data voltage signal, the second scanning signal has the second logic state to switch on the second transistor, the third transistor and the sixth transistor, so as to write the data voltage signal into the first node; and then, in a light-emitting phase, the first enable signal has the second logic state to switch on the fourth transistor, the fifth transistor and the sixth transistor, so as to make the first light-emitting element emit light.

In the above-mentioned pixel circuit, during the second half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, to write the data voltage signal into the first node; and then, in a light-emitting phase, the second enable signal has the second logic state to switch on the sixth transistor, the seventh transistor and the eighth transistor, so as to make the second light-emitting element emit light.

In the above-mentioned pixel circuit, the first transistor to the eighth transistor are all PMOS transistors, and the first logic state is a high level logic state, and the second logic state is a low level logic state.

In another alternative embodiment, the present application provides a pixel circuit comprising a first sub-pixel circuit and a second sub-pixel circuit; wherein the first sub-pixel circuit comprises a first light-emitting element which emits light in a first frame period, the second sub-pixel circuit comprises a second light-emitting element which emits light in a second frame period; the second frame period and the first frame period do not overlap.

In the above-mentioned pixel circuit, the second frame period follows the first frame period sequentially.

In the above-mentioned pixel circuit, the first sub-pixel circuit comprises:

a storage capacitor, connected between a first node and a first voltage input end;

a first transistor, connected between the first node and a second voltage input end;

a third transistor, connected between a second node and a data line input end;

a fourth transistor and a sixth transistor, connected in series between an anode of the first light-emitting element and the second node; wherein a control terminal of the sixth transistor is connected to the first node;

a second transistor, connected between the first node and a third node positioned at the interconnection point of the fourth transistor and the sixth transistor; and a fifth transistor, connected between the second node and the first voltage input end.

In the above-mentioned pixel circuit, the second sub-pixel circuit comprises:

a seventh transistor connected between the third node and an anode of the second light-emitting element; and an eight transistor connected in parallel with the fifth transistor.

In the above-mentioned pixel circuit, a first supply voltage is input to the first voltage input end, and a second supply voltage is input to the cathodes of the first light-emitting element and the second light-emitting element;

a first scanning signal is coupled to the control terminal of the first transistor, a second scanning signal is coupled to both the control terminals of the second transistor and the third transistor;

a first enable signal is coupled to both the control terminals of the fourth transistor and the fifth transistor, and a second enable signal is coupled to both the control terminals of the seventh transistor and the eighth transistor; and a data voltage signal is input to a first end of the third transistor, a second end of the third transistor is connected to the second node, and a reference voltage is input to a first end of the first transistor, a second end of the first transistor is connected to the first node.

In the above-mentioned pixel circuit, during the first half of the frame period, the second enable signal having a first logic state keeps the seventh transistor and the eight transistor being switched off, so as to switch off the second light-emitting element; during the second half of the frame period, the first enable signal having the first logic state keeps the fourth transistor and the fifth transistor being switched off, so as to switch off the first light-emitting element is switched off.

In the above-mentioned pixel circuit, during the first half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, so as to write the data voltage signal into the first node; and then in a light-emitting phase, the first enable signal has the second logic state to switch on the fourth transistor, the fifth transistor and the sixth transistor, so as to make the first light-emitting element emits light.

In the above-mentioned pixel circuit, during the second half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, to write the data voltage signal into the first node; and then in a light-emitting phase, the second enable signal has the second logic state to switch on the sixth transistor, the seventh transistor and the eighth transistor, so as to make the second light-emitting element emit light.

In the above-mentioned pixel circuit, the first transistor to the eighth transistor are all PMOS transistors, and the first logic state is a high level logic state, and the second logic state is a low level logic state.

BRIEF DESCRIPTIONS OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
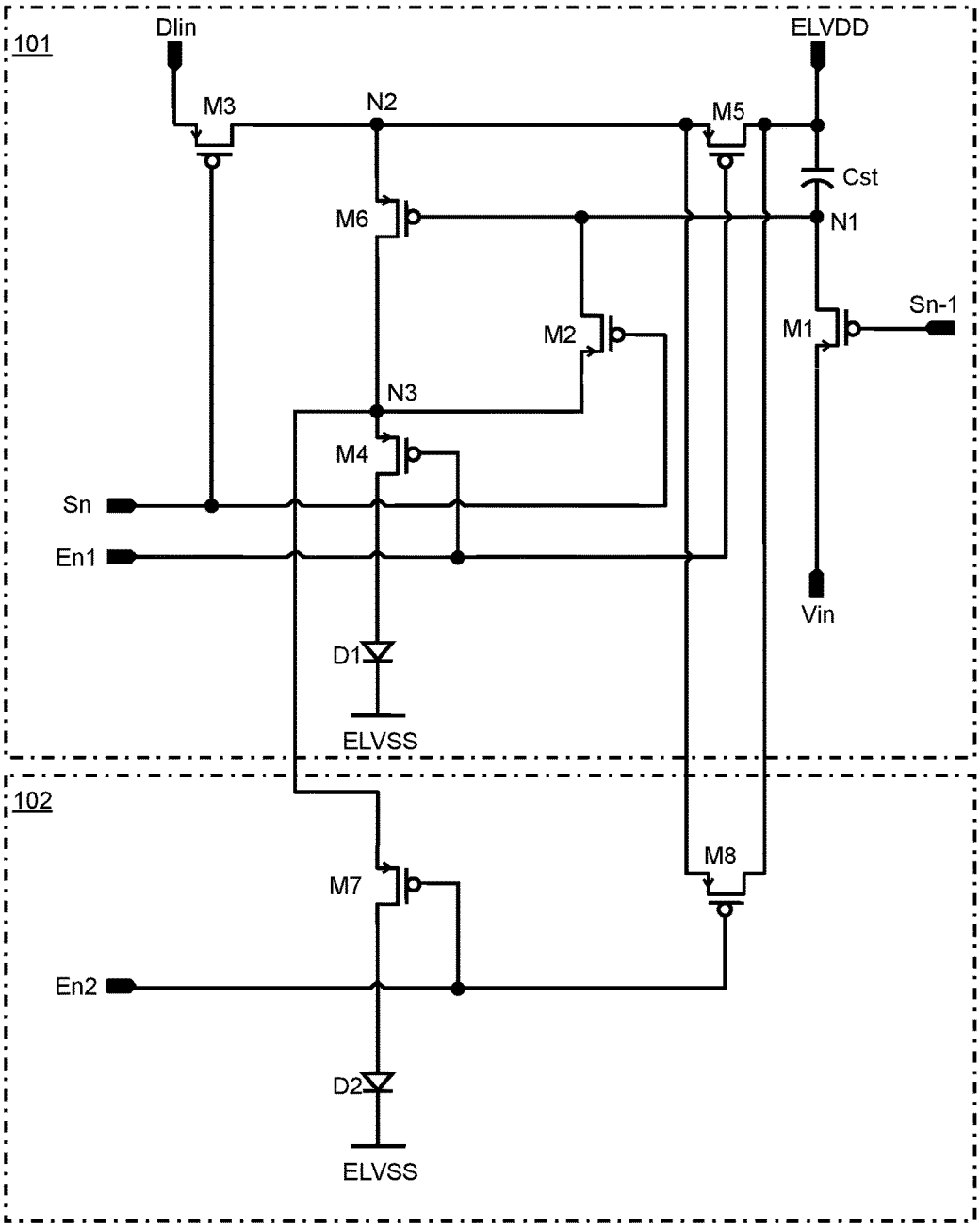
FIG. 1 is a basic framework of the pixel circuit of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

Embodiment 1

Figure 2:
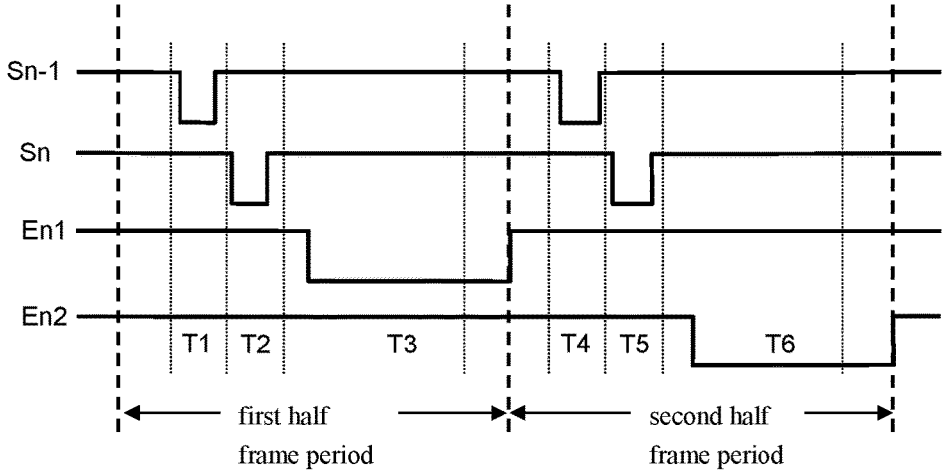
FIG. 2 is the time sequential control of the pixel circuit.

Refer to FIG. 1, compared to the design scheme in the prior art that a pixel compensating circuit only comprises a single pixel circuit, a basic pixel compensating circuit of the present invention comprises a first sub-pixel circuit 101 and a second sub-pixel circuit 102, corresponding to the time sequential control in FIG. 2, and a complete cycle of the pixel compensating circuit substantially comprises a first half of a frame period and a second half of the frame period, and specifically, the OLED light-emitting device of the first sub-pixel circuit 101 is lighted in the first half of the frame period, and the OLED light-emitting device of the second sub-pixel circuit 102 is lighted in the second half of the frame period, the present invention also provides a method that makes the first sub-pixel circuit 101 and the second sub-pixel circuit 102 have no crosstalk with each other.

In the first sub-pixel circuit 101, one end of the storage capacitor $C_{st}$ is connected to a first node N1, and the other end of the storage capacitor $C_{st}$ is connected to a first voltage input end ELVDD providing the supply voltage VDD. In addition, a reference voltage $V_{in}$ is input to a second voltage input end, and a first transistor M1 is connected between the first node N1 and the second voltage input end, and the reference voltage $V_{in}$ is input to a first end of the first transistor M1, and a second end of the first transistor M1 is connected to the first node N1.

In the first sub-pixel circuit 101, a fifth transistor M5 is connected between the first voltage input end ELVDD and a second node N2, and a third transistor M3 is connected between the second node N2 and a data line input end $D_{lin}$, wherein a first end of the fifth transistor M5 is connected to the second node N2 and a second end thereof is connected to the first voltage input end ELVDD, and a first end of the third transistor M3 is connected to the data line input end $D_{lin}$ and a second end thereof is connected to the second node N2.

In the first sub-pixel circuit 101, a sixth transistor M6 and a fourth transistor M4 are connected in series between the anode of the first light-emitting element D1 and the second node N2; a first end of the sixth transistor M6 is connected to the second node N2 and a second end thereof is connected to a first end of the fourth transistor M4; a second end of the fourth transistor M4 is connected to the anode of the first light-emitting element D1, wherein the control terminal of the sixth transistor M6 is connected to the first node N1. In addition, the second end of the sixth transistor M6 and the first end of the fourth transistor M4 are interconnected to a third node N3, and a second transistor M2 is connected between the third node N3 and the first node N1, and a second end of the second transistor M2 is connected to the first node N1, and a first end thereof is connected to the third node N3.

The above text introduces the first sub-pixel circuit 101, and the second sub-pixel circuit 102, which corresponds to the first sub-pixel circuit 101, comprises a second light-emitting element D2, a seventh transistor M7 and an eighth transistor M8. Wherein, the seventh transistor M7 is connected between the third node N3 of the first sub-pixel circuit 101 and the anode of the second light-emitting element D2, and the eighth transistor M8 is connected in parallel with the fifth transistor M5 of the first sub-pixel circuit 101. Specifically, a first end of the seventh transistor M7 is connected to the third node N3 and a second end thereof is connected to the anode of the second light-emitting element D2; a first end of the eighth transistor M8 is connected to the second node N2 and a second end thereof is connected to the first voltage input end ELVDD.

In some alternative embodiments, the first to eighth transistors M1-M8 mentioned here may choose p-type thin film transistor (TFT). Control terminals of the first to eighth transistors M1-M8 are gate electrodes, and first ends of the first to eighth transistors M1-M8 may be source electrodes (or drain electrodes) and second ends thereof correspondingly be configured to drain electrodes (or source electrodes). As an electronic switch, the control terminal of the transistor can control the first end and the second end to be switched on or off.

Refer to FIG. 1, in the first sub-pixel circuit 101, a first scanning signal $S_{n-1}$ is coupled to the control terminal of the first transistor M1, a second scanning signal $S_n$ is both coupled to the control terminals of the second transistor M2 and the third transistor M3, and a first enable signal En1 is both coupled to the control terminals of the fourth transistor M4 and the fifth transistor M5. In the second sub-pixel circuit 102, and a second enable signal En2 is both coupled to the control terminals of the seventh transistor M7 and the eighth transistor M8. In addition, the cathodes of the first light-emitting element D1 and the second light-emitting element D2 of the OLED device are usually connected to a third voltage input end ELVSS, and, generally, a low potential or a negative voltage VSS which is negative compared with a positive supply voltage VDD is input to the third voltage input end ELVSS. The voltage VDD is a high potential of various signal waveforms, generally from 5.5V to 7.5V, and the voltage VSS is a low potential of various signal waveforms, generally from −7V to −9V. It should be noticed that voltage values here are only as exemplary reference ranges of the present invention and not as limitations. In order to show distinctions, the present invention uses the first supply voltage to represent VDD, and the second supply voltage to represent VSS, and the former is larger than the latter.

Figure 3A:
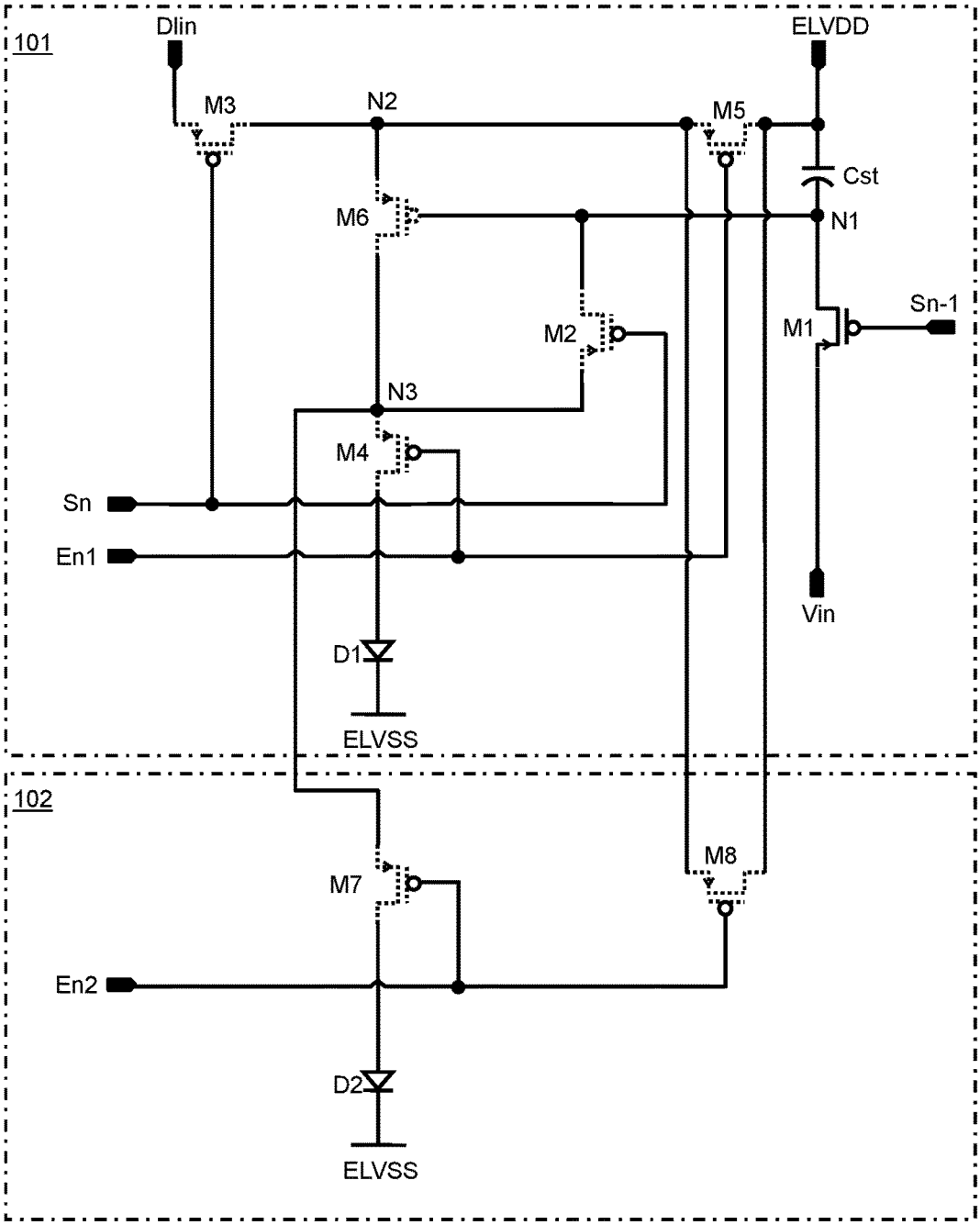
FIGS. 3A-3F are diagrams of responses of the pixel circuit based on the time sequential control in FIG. 2.

Refer to FIG. 3A, which shows on-off response actions of each transistor of the first sub-pixel circuit 101 and the second sub-pixel circuit 102 corresponding to the period T1 of the time sequential control in FIG. 2. During the first half of a frame period, at the beginning the first scanning signal $S_{n-1}$, the second scanning signal $S_n$, the first enable signal En1 and the second enable signal En2 are all high level, so that the first to eighth transistors M1-M8 are all switched off. While during the period T1, the first scanning signal $S_{n-1}$ is inverted to low level, and the second scanning signal $S_n$, the first enable signal En1 and the second enable signal En2 are still high level, so that the first transistor M1 is switched on yet the second to eighth transistors M2-M8 are switched off. During this period as the initialization signal of the storage capacitor $C_{st}$, the first scanning signal $S_{n-1}$ charges the storage capacitor $C_{st}$ at the first node N1, so that the voltage signal of the reference voltage $V_{in}$ is written into the storage capacitor $C_{st}$, and the electric potential of the first node N1 now is substantially $V_{in}$, and now the period T1 of the time sequential control is primarily the period of the storage capacitor $C_{st}$ being initialized.

Figure 3B:
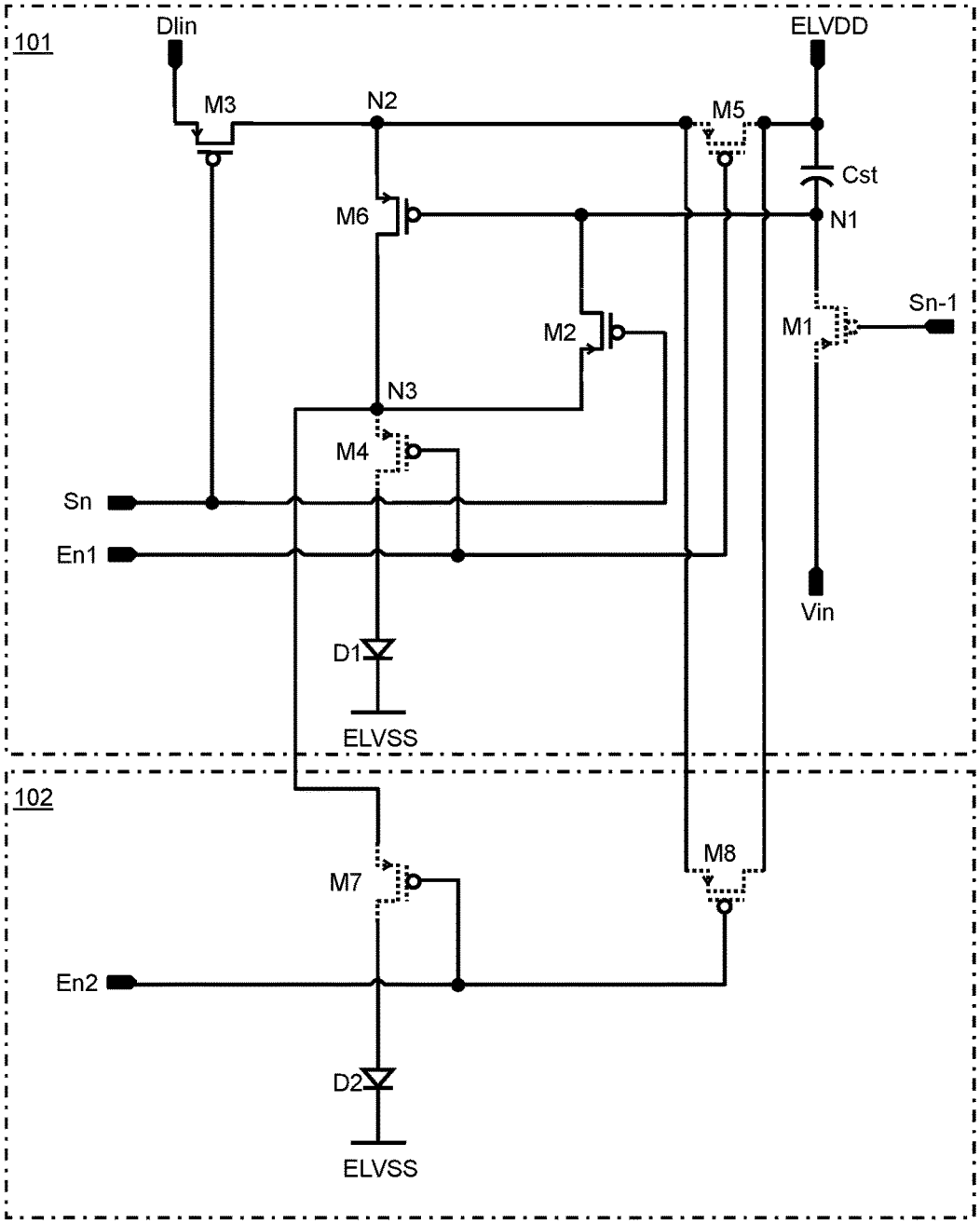

Refer to FIG. 3B, which shows on-off response actions of each transistor of the first sub-pixel circuit 101 and the second sub-pixel circuit 102 corresponding to the period T2 of the time sequential control in FIG. 2; the period T2 follows the period T1 sequentially. During the period T2 of the first half of the frame period, the first scanning signal $S_{n-1}$, the first enable signal En1 and the second enable signal En2 are both high level, the second scanning signal $S_n$ is low level, so that the second transistor M2 and the third transistor M3 are switched on, and the electric potential of the second node N2 is higher than the electric potential of the first node N1, so that the sixth transistor M6 is switched on. However the first transistor M1, the fourth transistor M4 and the fifth transistor M5, the seventh transistor M7 and the eighth transistor M8 are all switched off. The second scanning signal $S_n$ is mainly responsible for writing data provided in the data line to the first node N1, i.e. writing a data voltage signal $V_{data}$ input in the data line input end $D_{lin}$ of the first sub-pixel circuit 101; the writing process of the data is reflected in that, by the moment that the branches of the switched-on third transistor M3, the sixth transistor M6 and the second transistor M2 being in a critical conduction balance state, the electric potential of the first node N1 is substantially changed to $V_{data}-|V_{thp}|$, and the $V_{thp}$ is the threshold voltage of the sixth transistor M6, which is used as a driving transistor, similarly as a source-follow device. Now the period T2 of the time sequential control is primarily the writing phase of the data voltage signal.

Figure 3C:
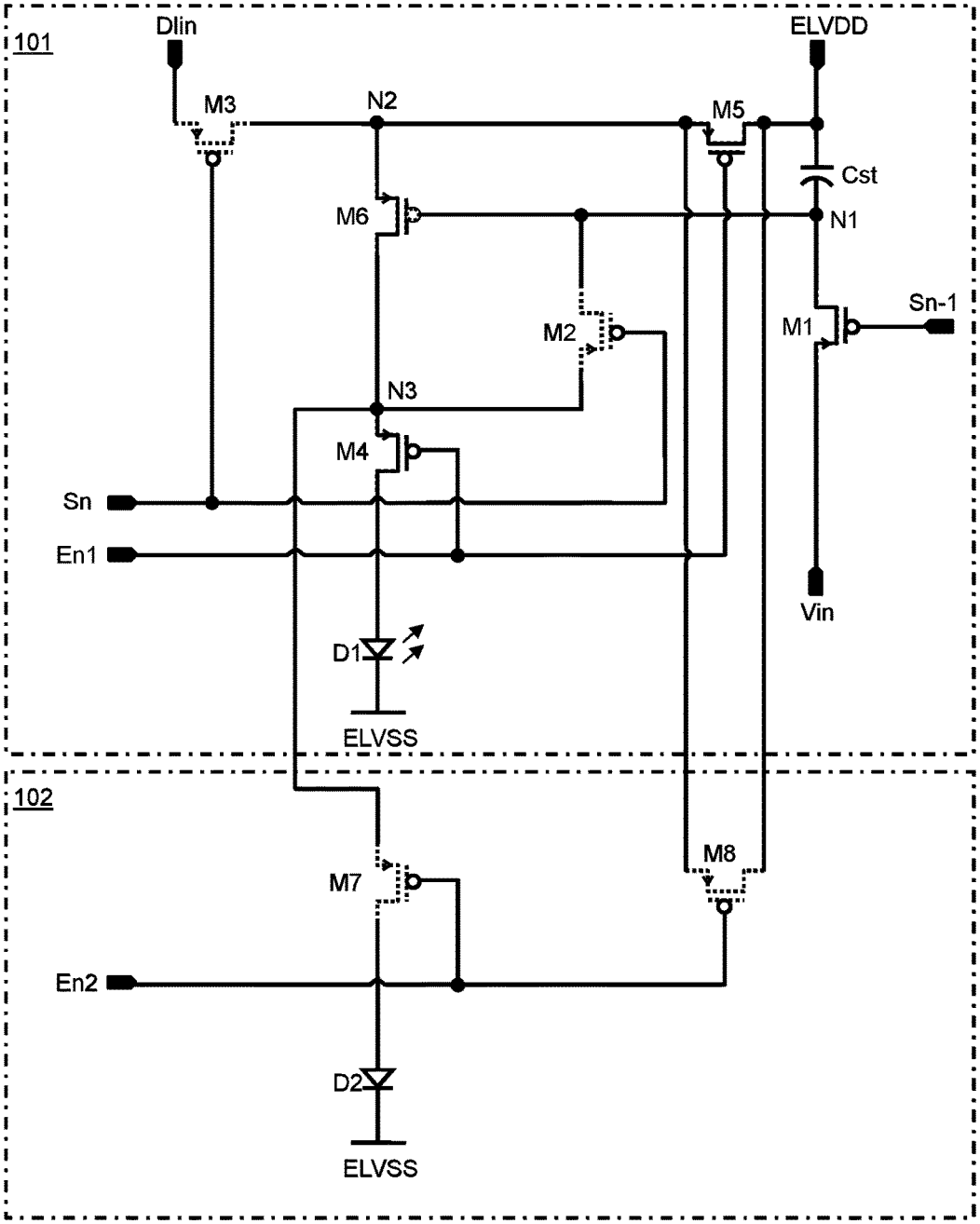

Refer to FIG. 3C, which shows on-off response actions of each transistor of the first sub-pixel circuit 101 and the second sub-pixel circuit 102 corresponding to the period T3 of the time sequential control in FIG. 2, and the period T3 follows the period T2 sequentially. During the period T3 of the first half of the frame period, the first scanning signal $S_{n-1}$, the second scanning signal $S_n$ and the second enable signal En2 are all high level potential, yet the first enable signal En1 is inverted to low level potential, so that the fourth transistor M4 and the fifth transistor M5 are switched on, and now the electric potential of the second node N2 is the supply voltage VDD which is larger than the electric potential $V_{data}-|V_{thp}|$ of the first node N1, so the sixth transistor M6 is also switched on. However the first transistor M1, the second transistor M2, the third transistor M3, the seventh transistor M7 and the eighth transistor M8 are all switched off. Finally, a conducting branch from the first voltage input end ELVDD providing the supply voltage VDD, to the fifth transistor M5, the sixth transistor M6, the fourth transistor M4, and to the cathode of the first light-emitting element D1 is formed to drive the first light-emitting element D1 to emit light; the electric current I flowing through the first light-emitting element D1 generally satisfies the following function relationship (wherein the parameter $\mu_p$ represents a carrier mobility of the sixth transistor M6, the parameter $C_{OX}$ represents a capacitance of gate oxide of the sixth transistor M6 per unit area, and the parameter W/L represents a ratio of width and length of a channel of the sixth transistor M6):

$$I = \frac{1}{2}\mu_p C_{OX}\frac{W}{L}(V_{GS}-V_{thp})^2 = \frac{1}{2}\mu_p C_{OX}\frac{W}{L}[V_{DD}-(V_{data}-|V_{thp}|)-|V_{thp}|]^2$$

$$\text{Thus, } I = \frac{1}{2}\mu_p C_{OX}\frac{W}{L}(V_{DD}-V_{data})^2$$

During the period T1, T2 and T3 of the first half of the frame period, the second enable signal En2 keeps a logic high state, so the seventh transistor M7 and the eighth transistor M8 are switched off in the first half of the frame period, and when the first light-emitting element D1 of the first sub-pixel circuit 101 is lighted, the second light-emitting element D2 of the second sub-pixel circuit 102 is shielded, so the first sub-pixel circuit 101 and the second sub-pixel circuit 102 do not cross talk.

Figure 3D:
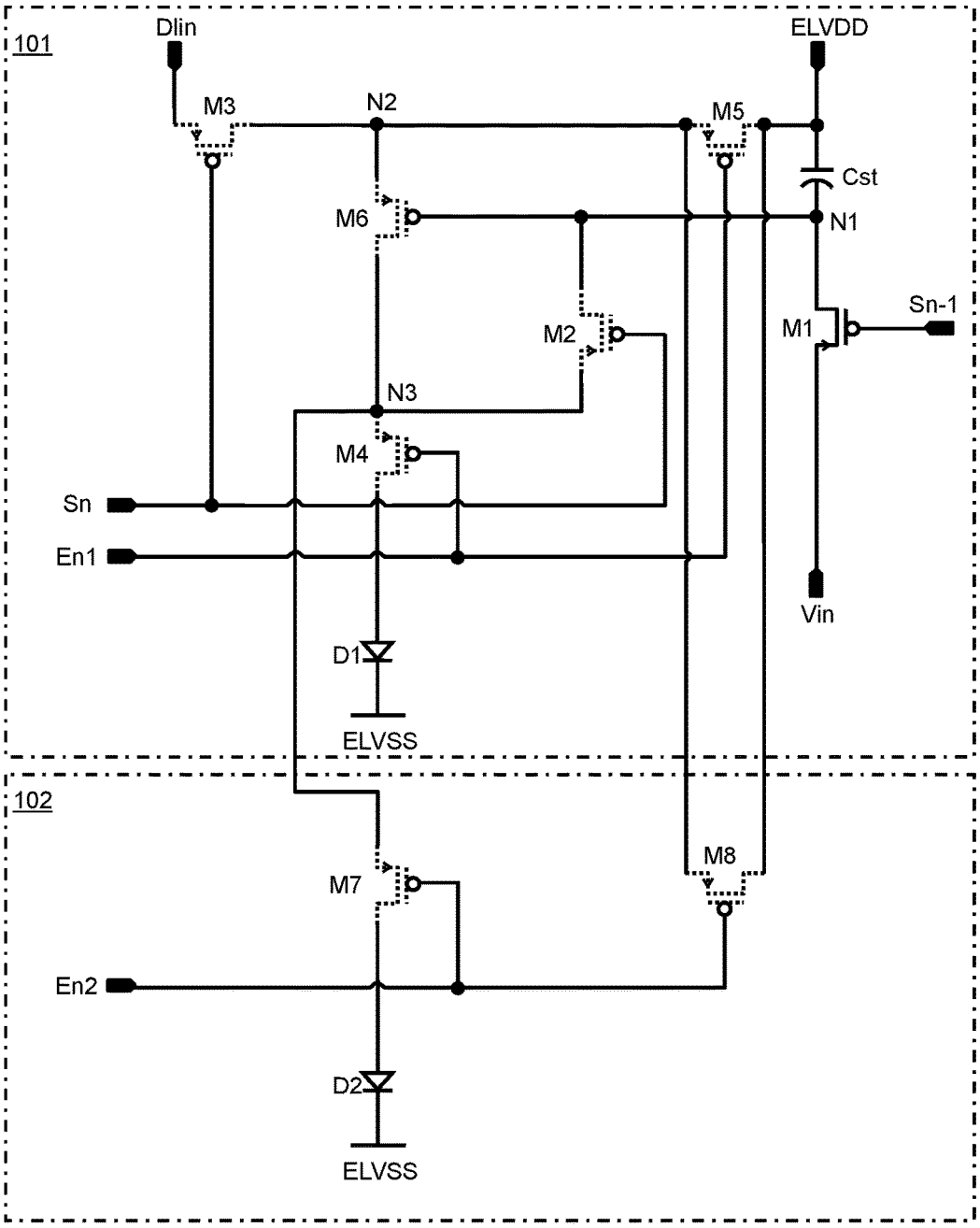
Figure 3E:
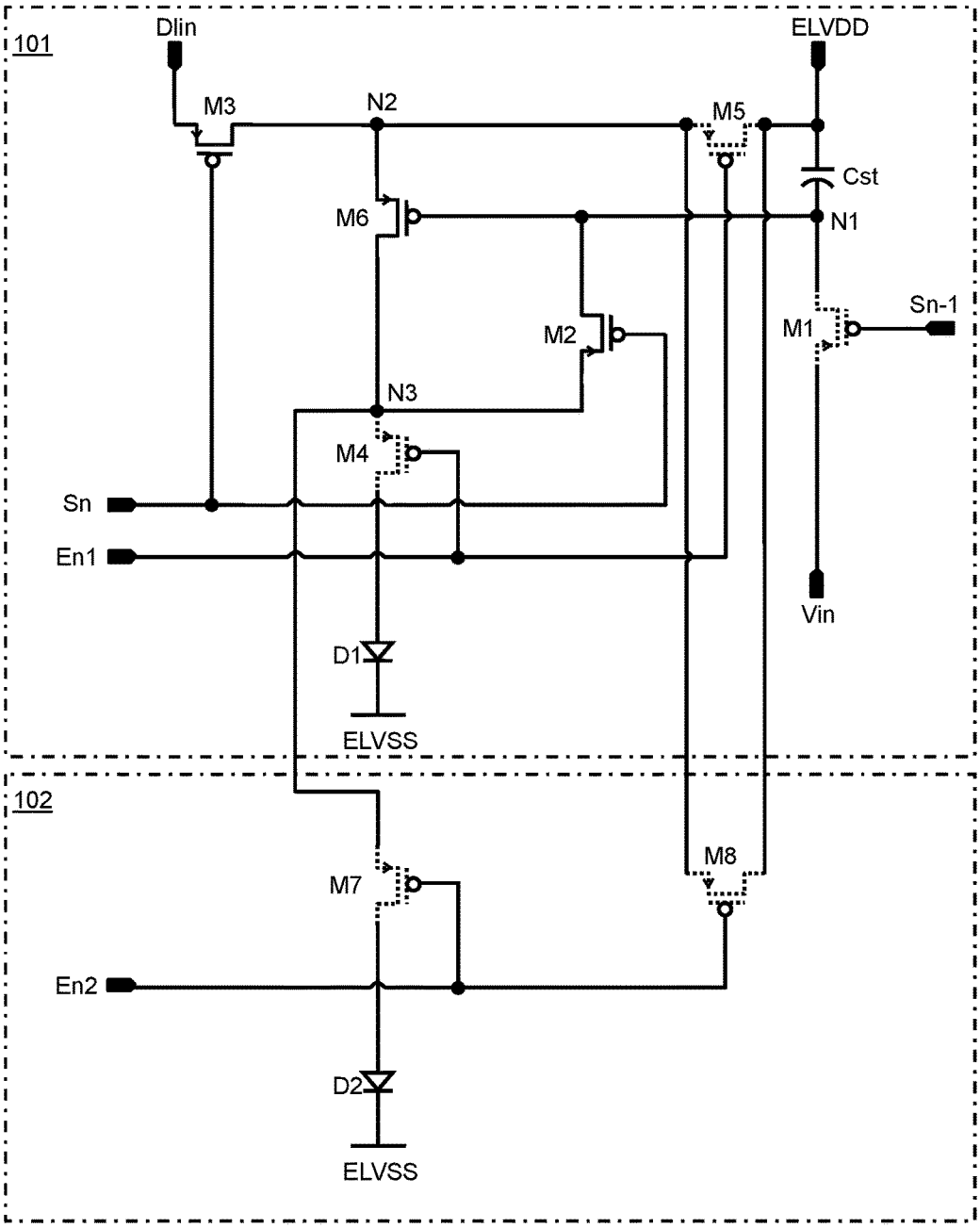
Figure 3F:
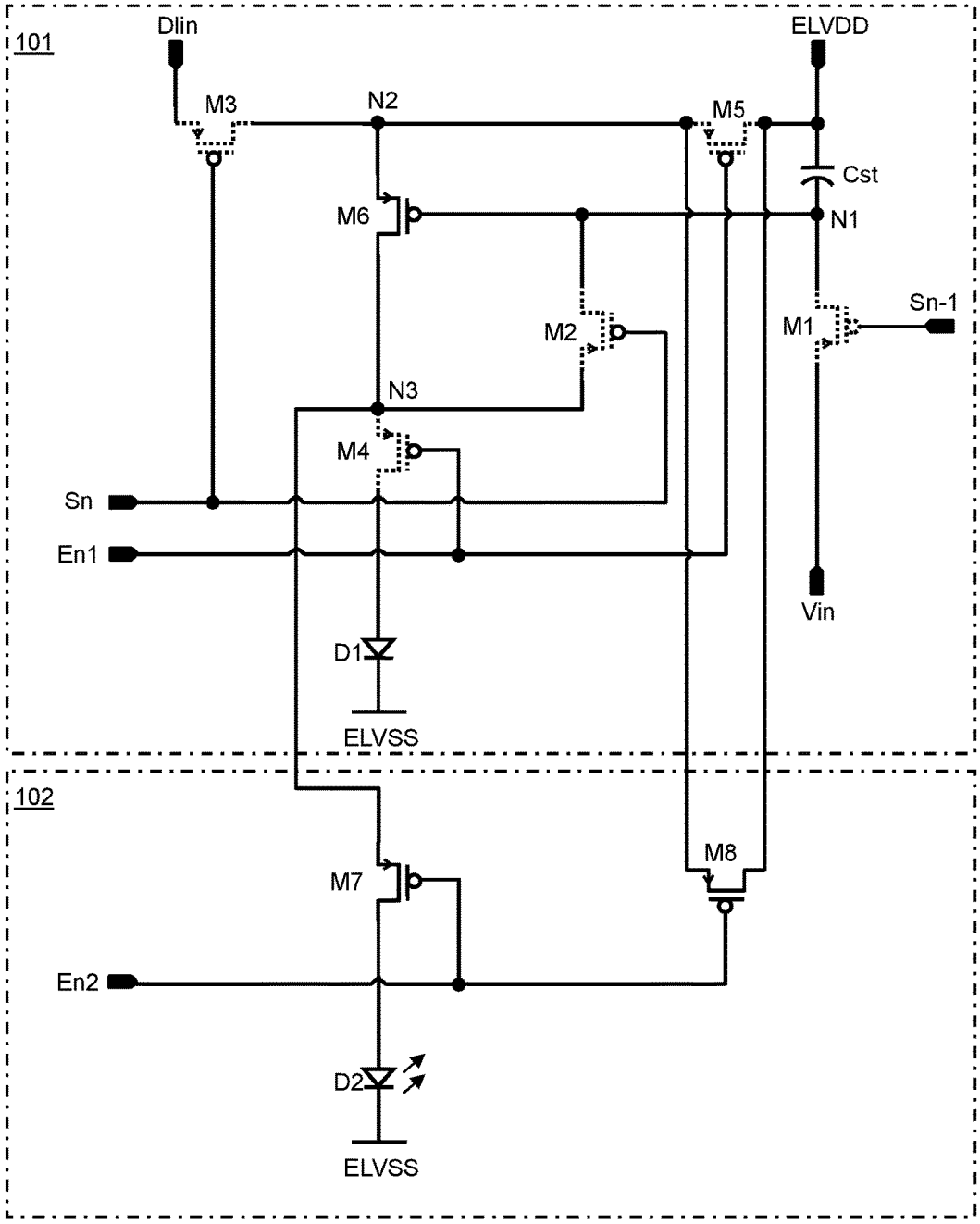

The above and FIGS. 3A-3C have detailed the timing sequence that the first light-emitting element D1 is lighted in the first half of the frame period, the following and FIGS. 3D-3F will continue to introduce the timing sequence that the second light-emitting element D2 is lighted in the second half of the frame period.

Refer to FIG. 3D, which shows on-off response actions of each transistor of the first sub-pixel circuit 101 and the second sub-pixel circuit 102 corresponding to the period T4 of the time sequential control in FIG. 2. During the second half of a frame period, at the beginning the first scanning signal $S_{n-1}$, the second scanning signal $S_n$, the first enable signal En1 and the second enable signal En2 are all high level potential, so that the first to eighth transistors M1-M8 are all switched off. While during the period T4, the first scanning signal $S_{n-1}$ is inverted to low level potential, and the second scanning signal $S_n$, the first enable signal En1 and the second enable signal En2 are still high level potential, so that the first transistor M1 is switched on yet the second to eighth transistors M2-M8 are switched off. During this period as the initialization signal of the storage capacitor $C_{st}$, the first scanning signal $S_{n-1}$ charges the storage capacitor $C_{st}$ at the first node N1, so that the voltage signal of the reference voltage $V_{in}$ is written into the storage capacitor $C_{st}$, the electric potential of the first node N1 now is substantially $V_{in}$.

Refer to FIG. 3E, which shows on-off response actions of each transistor of the first sub-pixel circuit 101 and the second sub-pixel circuit 102 corresponding to the period T5 of the time sequential control in FIG. 2, and the period T5 follows the period T4 sequentially. During the period T5 of the second half of the frame period, the first scanning signal $S_{n-1}$, the first enable signal En1 and the second enable signal En2 are all high level potential, the second scanning signal $S_n$ is low level potential, so that the second transistor M2 and the third transistor M3 are switched on, and the electric potential of the second node N2 is larger than the electric potential of the first node N1, so that the sixth transistor M6 is switched on. However the first transistor M1, the fourth transistor M4 and the fifth transistor M5, the seventh transistor M7 and the eighth transistor M8 are all switched off. When branches of the third transistor M3, the sixth transistor M6 and the second transistor M2 are in a critical conduction equilibrium state, the electric potential of the first node N1 is substantially changed to $V_{data}-|V_{thp}|$, the $V_{thp}$ is the threshold voltage of the sixth transistor M6.

Refer to FIG. 3F, which shows on-off response actions of each transistor of the first sub-pixel circuit 101 and the second sub-pixel circuit 102 corresponding to the period T6 of the time sequential control in FIG. 2, and the period T6 follows the period T5 sequentially. During the period T6 of the second half of the frame period, the first scanning signal $S_{n-1}$ and the second scanning signal $S_n$ are all high level potential, and the first enable signal En1 is high level potential, so that the first to fifth transistors M1-M5 are switched off, however the second enable signal En2 is inverted to low level potential, so that the seventh transistor M7 and the eighth transistor M8 are switched on, the electric potential of the second node N2 now flows through the eighth transistor M8 to become the supply voltage VDD, which is larger than the electric potential $V_{data}-|V_{thp}|$ of the first node N1, so the sixth transistor M6 is also switched on. Finally a conducting branch from the first voltage input end ELVDD providing the supply voltage VDD, to the eighth transistor M8, the sixth transistor M6 and the seventh transistor M7, and to the cathode of the second light-emitting element D2 is formed to make the second light-emitting element D2 to emit light. Since the present invention has detailed the approximate calculation formula of the electric current I flowing through the first light-emitting element D1, and in view of the electric current flowing through the second light-emitting element D2 may also use the formula, so it will not be repeated here.

Figure 4:
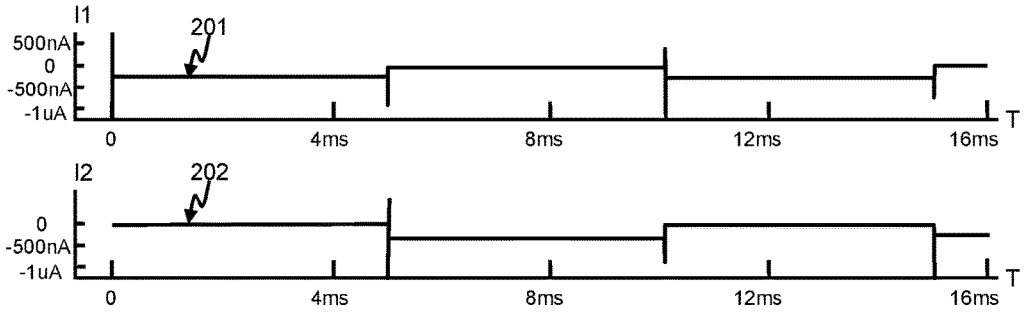
FIG. 4 shows the electric current flowing through the OLED light-emitting element of the first sub-pixel circuit and the second sub-pixel circuit.

During the period T4, T5 and T6 of the second half of the frame period, the first enable signal En1 keeps high level, so the fourth transistor M4 and the fifth transistor M5 are switched off in the second half of the frame period, and when the second light-emitting element D2 of the second sub-pixel circuit 102 is lighted, the first light-emitting element D1 of the first sub-pixel circuit 101 is shielded, so the first sub-pixel circuit 101 and the second sub-pixel circuit 102 will not produce crosstalk. Further, the current curve 201 in FIG. 4 represents the electric current I1 flowing through the first light-emitting element D1 of the OLED, and the current curve 202 represents the electric current I2 flowing through the second light-emitting element D2 of the OLED, it can be observed that at this moment the pixel compensating circuit can output stable current to the OLED according to the timing sequence. Obviously, an advantage of the present invention is that, the second sub-pixel circuit 102 shares the storage capacitor $C_s$ of the first sub-pixel circuit 101, and the first transistor M1, the second transistor M2, the third transistor M3 and the sixth transistor M6 of the first sub-pixel circuit 101. No doubt, when topologies for the second sub-pixel circuit 102 being structured, the components being shared can be omitted and not repeated in the second sub-pixel circuit 102, which obviously saves components costs, shortens the development cycle and significantly reduces the size of the display panel, and particularly provides high-resolution synchronously, which are desired by those skilled in the art.

Embodiment 2

Based on the above-mentioned Embodiment 1, in another embodiment of the present application, a basic pixel compensating circuit may comprise a first sub-pixel circuit 101 and a second sub-pixel circuit 102, and the OLED light-emitting device of the first sub-pixel circuit 101 can be lighted in a first frame period, and the OLED light-emitting device of the second sub-pixel circuit 102 can be lighted in a second frame period which is not overlapped with the first frame period, so as to reduce the overall size of the pixel circuit, while it also provides a method that the first sub-pixel circuit 101 and the second sub-pixel circuit 102 have no crosstalk.

Preferably, the above mentioned second frame period follows the above mentioned first frame period sequentially; for example corresponding to the time sequential control diagram of FIG. 2, the first frame period may correspond to the first half of the frame period of a complete cycle of the pixel compensating circuit of the embodiment, and the second frame period may correspond to the second half of the frame period of the above mentioned complete cycle, i.e. the OLED light-emitting device of the first sub-pixel circuit 101 is lighted in the first half of the frame period, and the OLED light-emitting device of the second sub-pixel circuit 102 is lighted in the second half of the frame period, and technical features similar to Embodiment 1 can be used to achieve that the first sub-pixel circuit 101 and the second sub-pixel circuit 102 have no crosstalk.

It should be noticed that, since the basic ideas and the embodiments of the pixel circuit in Embodiment 1 and Embodiment 2 are approximate, so that the technical features described in Embodiment 1 can be adaptively applied to Embodiment 2; similarly, technical features described in Embodiment 2 can be adaptively applied to Embodiment 1; and in order to elaborate simplicity, the technical features in Embodiment 2 which are familiar to those skilled in the art and similar or correspond to technical features in Embodiment 1 are not repeated, which should not be considered as limitations for technical solutions of the present application.

The foregoing is only the preferred embodiments of the invention, not thus limiting embodiments and scope of the invention, those skilled in the art should be able to realize that the schemes obtained from the content of specification and Figures of the invention are within the scope of the invention.

What is claimed is:

1. A pixel circuit, comprising a first sub-pixel circuit and a second sub-pixel circuit; the first sub-pixel circuit comprising a first light-emitting element and the second sub-pixel circuit comprising a second light-emitting element, wherein the first light-emitting element emits light in a first half of a frame period, and the second light-emitting element emits light in the second half of the frame period;

wherein the first sub-pixel circuit comprises:

a storage capacitor, connected between a first node and a first voltage input end;

a first transistor, connected between the first node and a second voltage input end, wherein a reference voltage is input to the second voltage input end;

a third transistor, connected between a second node and a data line input end;

a fourth transistor and a sixth transistor, connected in series between an anode of the first light-emitting element and the second node; wherein a control terminal of the sixth transistor is connected to the first node;

a second transistor connected between the first node and a third node positioned at the interconnection point of the fourth transistor and the sixth transistor; and a fifth transistor connected between the second node and the first voltage input end; wherein the second sub-pixel circuit comprises:

a seventh transistor, connected between the third node and an anode of the second light-emitting element; and an eighth transistor, connected in parallel with the fifth transistor;

a first supply voltage is input to the first voltage input end, and a second supply voltage is input to the cathodes of the first light-emitting element and the second light-emitting element;

a first scanning signal is coupled to the control terminal of the first transistor, a second scanning signal is coupled to both the control terminals of the second transistor and the third transistor;

said reference voltage is not said first scanning signal or said second scanning signal;

a first enable signal is coupled to both the control terminals of the fourth transistor and the fifth transistor, and a second enable signal is coupled to both the control terminals of the seventh transistor and the eighth transistor; and a data voltage signal is input to a first end of the third transistor, a second end of the third transistor is connected to the second node, and a reference voltage is input to a first end of the first transistor, a second end of the first transistor is connected to the first node.

2. The pixel circuit according to claim 1, wherein during the first half of the frame period, the second enable signal having a first logic state keeps the seventh transistor and the eight transistor being switched off, so as to switch off the second light-emitting element; during the second half of the frame period, the first enable signal having the first logic state keeps the fourth transistor and the fifth transistor being switched off, so as to switch off the first light-emitting element.

3. The pixel circuit according to claim 2, wherein during the first half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, so as to write the data voltage signal to the first node; and then in a light-emitting phase, the first enable signal has the second logic state to switch on the fourth transistor, the fifth transistor and the sixth transistor, so as to make the first light-emitting element emit light.

4. The pixel circuit according to claim 3, wherein the first transistor to the eighth transistor are all PMOS transistors, and the first logic state is a high level logic state, and the second logic state is a low level logic state.

5. The pixel circuit according to claim 2, wherein during the second half of the frame period, in an initialization phase of the storage capacitor, the first scanning signal has a second logic state to switch on the first transistor, and initialize the electric potential of the first node to the reference voltage level; and then in a writing phase of the data voltage signal, the second scanning signal has the second logic state to switch on the second transistor, the third transistor and the sixth transistor, to write the data voltage signal into the first node; and then in a light-emitting phase, the second enable signal has the second logic state to switch on the sixth transistor, the seventh transistor and the eighth transistor, so as to make the second light-emitting element emit light.

6. The pixel circuit according to claim 5, wherein the first transistor to the eighth transistor are all PMOS transistors, and the first logic state is a high level logic state, and the second logic state is a low level logic state.

7. A pixel circuit comprising a first sub-pixel circuit and a second sub-pixel circuit; wherein the first sub-pixel circuit comprises a first light-emitting element, and the first light-emitting element emits light in a first frame period, and the second sub-pixel circuit comprises a second light-emitting element, and the second light-emitting element emits light in a second frame period; the second frame period and the first frame period do not overlap;

wherein the first sub-pixel circuit comprises:

a storage capacitor, connected between a first node and a first voltage input end;

a first transistor, connected between the first node and a second voltage input end, wherein a reference voltage is input to the second voltage input end;

a third transistor, connected between a second node and a data line input end;

a fourth transistor and a sixth transistor, connected in series between the anode of the first light-emitting element and the second node; wherein a control terminal of the sixth transistor is connected to the first node;

a second transistor, connected between the first node and a third node positioned at the interconnection point of the fourth transistor and the sixth transistor; and a fifth transistor, connected between the second node and the first voltage input end; wherein the second sub-pixel circuit comprises:

a seventh transistor, connected between the third node and an anode of the second light-emitting element; and an eighth transistor, connected in parallel with the fifth transistor;

a first supply voltage is input to the first voltage input end, and a second supply voltage is input to the cathodes of the first light-emitting element and the second light-emitting element;

a first scanning signal is coupled to the control terminal of the first transistor, a second scanning signal is coupled to both the control terminals of the second transistor and the third transistor;

said reference voltage is not said first scanning signal or said second scanning signal;

a first enable signal is coupled to both the control terminals of the fourth transistor and the fifth transistor, and a second enable signal is coupled to both the control terminals of the seventh transistor and the eighth transistor; and a data voltage signal is input to a first end of the third transistor, a second end of the third transistor is connected to the second node, and a reference voltage is input to a first end of the first transistor, a second end of the first transistor is connected to the first node.

8. The pixel circuit according to claim 7, wherein the second frame period follows the first frame period sequentially.

9. The pixel circuit according to claim 7, wherein during the first half of the frame period, the second enable signal having a first logic state keeps the seventh transistor and the eight transistor being switched off, so as to switch off the second light-emitting element; during the second half of the frame period, the first enable signal having the first logic state keeps the fourth transistor and the fifth transistor being switched off, so as to switch off that the first light-emitting element.

10. The pixel circuit according to claim 9, wherein during the first half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, so as to write the data voltage signal to the first node; and then in a light-emitting phase, the first enable signal has the second logic state to switch on the fourth transistor, the fifth transistor and the sixth transistor, so as to make the first light-emitting element emit light.

11. The pixel circuit according to claim 10, wherein the first transistor to the eighth transistor are all PMOS transistors, and the first logic state is a high level logic state, and the second logic state is a low level logic state.

12. The pixel circuit according to claim 9, wherein during the second half of the frame period, in an initialization phase of the storage capacitor, the first scanning signal has a second logic state to switch on the first transistor, and initialize the electric potential of the first node into the reference voltage level; and then in a writing phase of the data voltage signal, the second scanning signal has the second logic state to switch on the second transistor, the third transistor and the sixth transistor, to write the data voltage signal into the first node; and then in a light-emitting phase, the second enable signal has the second logic state to switch on the sixth transistor, the seventh transistor and the eighth transistor, so as to make the second light-emitting element emit light.

13. The pixel circuit according to claim 12, wherein the first transistor to the eighth transistor are all PMOS transistors, and the first logic state is a high level logic state, and the second logic state is a low level logic state.

* * * * *